US006996877B2

(12) United States Patent
Booker et al.

(10) Patent No.: US 6,996,877 B2
(45) Date of Patent: Feb. 14, 2006

(54) SNAP-ON HINGE ASSEMBLY

(75) Inventors: Todd Booker, Garner, NC (US); Georg Domenig, Kernersville, NC (US)

(73) Assignee: Grass America Inc., Kernersville, NC (US)

( * ) Notice: Subject to any disclaimer, the term of this patent is extended or adjusted under 35 U.S.C. 154(b) by 35 days.

(21) Appl. No.: 10/815,364

(22) Filed: Apr. 1, 2004

(65) Prior Publication Data

US 2004/0216272 A1 Nov. 4, 2004

Related U.S. Application Data

(60) Provisional application No. 60/459,437, filed on Apr. 1, 2003.

(51) Int. Cl.
*E05D 7/10* (2006.01)

(52) U.S. Cl. ..... 16/257; 16/258; 16/236; 16/382

(58) Field of Classification Search ..... 16/257, 16/258, 236–238, 242, 248, 382
See application file for complete search history.

(56) References Cited

U.S. PATENT DOCUMENTS

| | | | | | |
|---|---|---|---|---|---|
| 4,716,622 | A | | 1/1988 | DeBruyn | |
| 5,025,530 | A | * | 6/1991 | Ferrari et al. | 16/236 |
| 5,056,190 | A | * | 10/1991 | Rock et al. | 16/240 |
| 5,105,506 | A | * | 4/1992 | Lin | 16/258 |
| 5,159,740 | A | * | 11/1992 | Brustle et al. | 16/258 |
| 5,210,907 | A | * | 5/1993 | Toyama | 16/258 |
| 5,224,242 | A | * | 7/1993 | Marjanovic | 16/258 |
| 5,295,282 | A | | 3/1994 | Lautenschlager | |
| 5,392,493 | A | | 2/1995 | Youngdale | |
| 5,511,287 | A | | 4/1996 | Lautenschlager et al. | |
| 5,937,479 | A | * | 8/1999 | Ohshima et al. | 16/257 |
| 6,032,333 | A | * | 3/2000 | Brustle | 16/242 |
| 6,088,879 | A | * | 7/2000 | Gasser | 16/257 |
| 6,148,479 | A | * | 11/2000 | Lin | 16/258 |
| 6,240,599 | B1 | | 6/2001 | Peer et al. | |
| 6,339,864 | B1 | * | 1/2002 | Albrecht et al. | 16/258 |
| 6,643,895 | B1 | | 11/2003 | Domenig et al. | |
| 6,647,591 | B1 | | 11/2003 | Domenig et al. | |
| 6,694,567 | B1 | | 2/2004 | Domenig et al. | |
| 6,880,205 | B1 | * | 4/2005 | Rupprechter | 16/235 |

FOREIGN PATENT DOCUMENTS

| | | | |
|---|---|---|---|
| GB | 2322667 A | * | 9/1998 |
| JP | 03172477 A | * | 7/1991 |
| JP | 03194083 A | * | 8/1991 |

* cited by examiner

*Primary Examiner*—Chuck Y. Mah
(74) *Attorney, Agent, or Firm*—John M. Harrington; Kilpatrick Stockton LLP

(57) ABSTRACT

This invention relates to a hinge assembly comprising a frame plate for engagement to a furniture frame member comprising means for engaging a spring assembly, an intermediate plate comprising means for rotatably engaging the intermediate plate with a pin, and two side members, a spring assembly for releasably engaging the intermediate plate to the frame plate, and, a base plate comprising two side members each having at least one aperture therein, and a pin. The pin extends through the apertures on the side members of the base plate and the means for rotatably engaging the intermediate plate with a pin provide a slideable engagement between the base plate and the intermediate plate, and the spring assembly provides a releasable engagement between the frame plate and the intermediate plate.

21 Claims, 9 Drawing Sheets

Section
I-I

Section
II-II

Section
III-III

Section
I-I

Section
II-II

SNAP-ON HINGE ASSEMBLY

CROSS-REFERENCE TO RELATED APPLICATIONS

This application claims priority to co-pending U.S. Provisional Application No. 60/459,437, filed Apr. 1, 2003, entitled "SNAP-ON HINGE ARM", herein incorporated by reference in its entirety.

FIELD OF THE INVENTION

The present invention relates generally to hinge devices for mounting a door on a furniture article, and more particularly to hinge devices wherein the hinge components may be easily separated without tools to provide easy removal of the furniture doors.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282; 5,392,493; and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

Furthermore, cabinet manufacturers and consumers often need to remove cabinet doors after they are installed. For example, if a cabinet is to be painted or moved after installation, an easily removable door, one that could be snapped on and off without tools, would be desirable. Currently hinges are attached to furniture frame members with screws or bolts. To remove a hinge, one must unscrew the hinge frame plate from the frame member, or unscrew the hinge cup from the door. This leaves a hole in the frame member from the screw, and repeated unscrewing will wear the frame material until it no longer holds a screw. Materials such as fiberboard will crack and chip quite easily preventing the hinge from being removed once installed. It would, therefore, be desirable to have a hinge assembly that can be removed from the furniture frame member without having to unscrew the anchor members from the frame.

SUMMARY OF THE INVENTION

Accordingly, the above-identified shortcomings of existing adjustable hinges are overcome by embodiments of the present invention. The general purpose of the present invention, which will be described in greater detail below, is to provide new and improved adjustable hinges for mounting a door on a frame of a furniture article such as a cabinet or desk, that is easily removable through a snap-fit connection between the various parts of the hinge assembly.

In one embodiment of the present invention, a hinge assembly is provided comprising a frame plate for engagement to a furniture frame member comprising means for engaging a spring assembly, an intermediate plate comprising means for rotatably engaging the intermediate plate with a pin, and two side members, a spring assembly for releasably engaging the intermediate plate to the frame plate, and a base plate comprising two side members each having at least one aperture therein, and a pin. The pin extends through the apertures on the side members of the base plate and the means for rotatably engaging the intermediate plate with a pin provide a slideable engagement between the base plate and the intermediate plate, and the spring assembly provides a releasable engagement between the frame plate and the intermediate plate.

In one embodiment of the present invention, the intermediate plate is rotatably engaged with a pin through at least one aperture on each of the side members of the intermediate plate through which the pin extends. In an alternate embodiment of the present invention, the intermediate plate is rotatably engaged with a pin through two hooks extending from the intermediate plate and wrapping at least partially around the pin.

In a preferred embodiment of the present invention, the spring assembly comprises a push button spring assembly. In this embodiment, the frame plate further comprises two front catch members, and two rear hook portions, the intermediate plate further comprises two front apertures on the side members, and the push button spring assembly comprises a push button facing the rear of the hinge assembly having two step members tensioned against the hook portions by two springs compressed between the pin and the push button, such that the intermediate plate is separably engageable to the frame plate through the interaction between the front catch members of the frame plate and the front apertures of the intermediate plate side members and the rear hook portions and the step members.

In another preferred embodiment of the present invention, the spring assembly comprises a leaf spring. In this embodiment the frame plate further comprises a plurality of hook members and means for engaging a leaf spring, the intermediate plate further comprises a plurality of hook engagement members and a spring engagement tab, such that the intermediate plate is separably engageable to the frame plate by sliding the hook engagement members into the hooks of the frame plate and securing the leaf spring to the tab on the intermediate member.

An additional embodiment of the present invention provides a base plate further comprising two adjustment screws for adjusting the position of a furniture door engaged to the hinge assembly.

In a further embodiment of the present invention, a hinge assembly is provided comprising a frame plate comprising means for securing said frame plate to a furniture frame member, at least one rear hook member extending from the body of said frame plate, and at least one front catch member, an intermediate plate comprising a body portion having comprising means for engaging the front catch member of the frame plate, and a push button assembly comprising at least one spring, and at least one step on the push button for engaging the rear hook member of the frame plate, said at least one spring being positioned to supply tension to the push button such that the step engages the at least one rear hook member of the frame plate, and a base plate comprising means for securing the base plate to the intermediate plate.

A further embodiment of the present invention provides a depth adjustment screw for adjusting the depth of the door relative to the furniture frame member, and a horizontal adjustment screw for adjusting the position of the door horizontally relative to the furniture frame member.

In another embodiment of the present invention, the frame plate comprises two rear hook members and two front catch members, the intermediate plate comprises two side members which extend from opposite sides of the intermediate plate and comprise rear apertures for receiving the pin and front apertures for engaging each of the front catch members of the frame plate.

In a preferred embodiment of the present invention, the push button assembly comprises two springs and two steps on the push button for engaging the rear hook members of the frame plate. Further, the intermediate plate and the base plate are releaseable from the frame plate by pressing the push button against the force of the springs until the steps on the push button disengage from the hook members on the frame plate thereby allowing the intermediate plate to be separated from the frame plate.

In an additional embodiment of the present invention the push button comprises means for receiving the pin and securing the springs against said pin under tension, such that the springs provide force to extend the push button toward the rear of the hinge.

Another embodiment of the present invention provides a base plate which substantially covers the intermediate plate and the frame plate when the hinge assembly is assembled and installed in a furniture article.

In another embodiment of the present invention, a hinge assembly is provided comprising a frame plate comprising means for securing the frame plate to the furniture frame, a plurality of hook members extending from opposite sides of the frame plate, and a retention spring securely attached to a front end of the frame plate and extending towards the back end of the frame plate between the plurality of hook members, an intermediate plate comprising a plurality of protrusions which engage the plurality of hook members on the frame plate, and means for releasably engaging the intermediate plate to the retention spring, and a base plate comprising a body portion and a leg portion extending substantially perpendicular from the front end of said body portion, and means for adjustably connecting the base plate to the intermediate plate.

In one embodiment of the present invention, the plurality of hook members on the frame plate further comprises four hook members. Further, in a preferred embodiment of the present invention, the retention spring comprises a leaf spring and the means for releasably engaging the retention spring comprises an inward facing tab extending from a back end of the intermediate plate and through an aperture in the retention spring.

In a preferred embodiment of the present invention, the intermediate plate and base plate are released from the frame plate by pressing a finger tab on the retention spring to move the rearward portion of the retention spring away from the tab, thereby releasing the tension in the spring and allowing the base plate and intermediate plate to be removed from the frame plate. Furthermore, the base plate substantially covers the intermediate plate and frame plate when the hinge assembly is assembled and installed in a furniture article.

A feature and advantage of the present invention is a hinge assembly that comprises a snap-together design to allow installation and removal of furniture doors from the furniture frame without the need for tools.

A feature and advantage of the present invention is a hinge assembly that can be removed from the furniture frame member without having to unscrew the anchor members from the frame.

A feature and advantage of the present invention is a low profile hinge assembly with a snap-together assembly.

A feature and advantage of the present invention is a full overlay hinge assembly with a snap-together assembly.

A feature and advantage of the present invention is a compact hinge assembly that is relatively flat and protrudes minimally into the interior of the furniture member.

DETAILED DESCRIPTION

The present invention provides hinges for mounting doors on furniture frames such as a desk or cabinet. These hinges may be removed from the furniture frame by releasing a snap fit connection between two of the hinge plates, one mounted on the furniture member and one adapted to be pivotably mounted to a hinge cup.

The present invention provides several embodiments of a hinge assembly comprising a frame plate, an intermediate plate, and a base plate, wherein the base plate and intermediate plate are releasably engaged to the frame plate through a spring assembly. The various embodiments of the present invention will be discussed with respect to the two preferred hinge assemblies; a low-profile hinge assembly and a full overlay hinge assembly. However, it should be recognized that the spring assemblies discussed with respect to each hinge assembly can be interchanged and employed with the alternate hinge assembly. Additionally, other hinge assemblies can be employed with the spring assemblies discussed herein.

For the purposes of promoting an understanding of the invention, reference will now be made to some preferred embodiments of the present invention as illustrated in FIGS. 1–9, and specific language used to describe the same. Numerous specific details are set forth below in order to provide a thorough understanding of the present invention. However, it will be obvious to one skilled in the art that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

Furthermore, for the purposes of this description reference will be made to several directional vectors used to describe the orientation of the hinge components with respect to one another. These directional vectors are for the purposes of illustration and understanding only and are not meant to limit the scope of the invention. The hinge assemblies shall be referred to from "front" to "rear" with the front being the portion of the hinge assembly closest to the furniture door when the hinge assembly is installed, and the rear begin the portion of the hinge farthest from the door, closest to the interior of the furniture body. "Top" and "bottom" or "outward" and "inward", respectively, refer to the assembled hinge with the base plate comprising the "top" or "outward" most portion of the hinge, and the frame plate comprising the "bottom" or "inward" most portion of the hinge.

Figure 1:
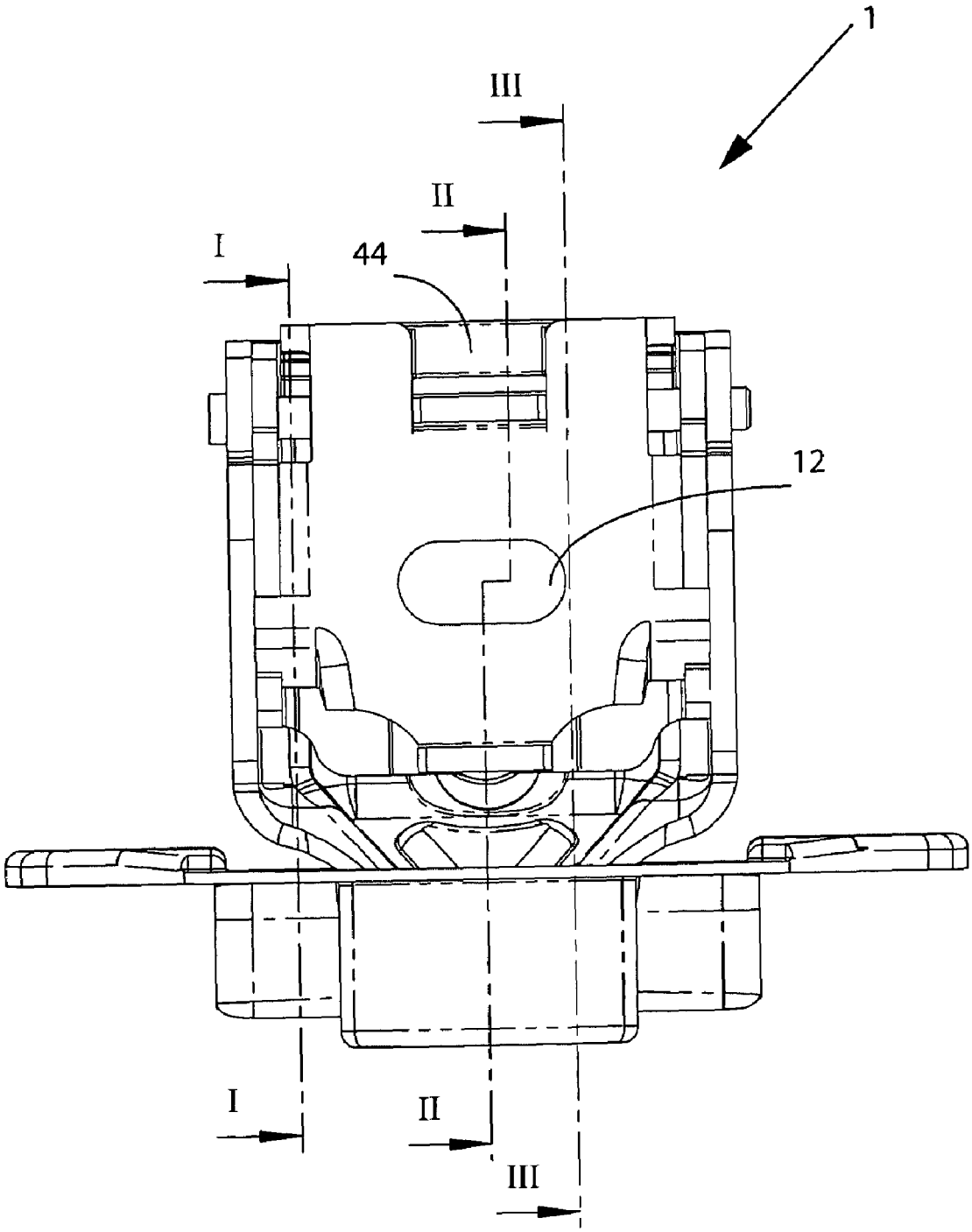
FIG. 1 illustrates a bottom view of a snap-on hinge of the present invention.
Figure 2:
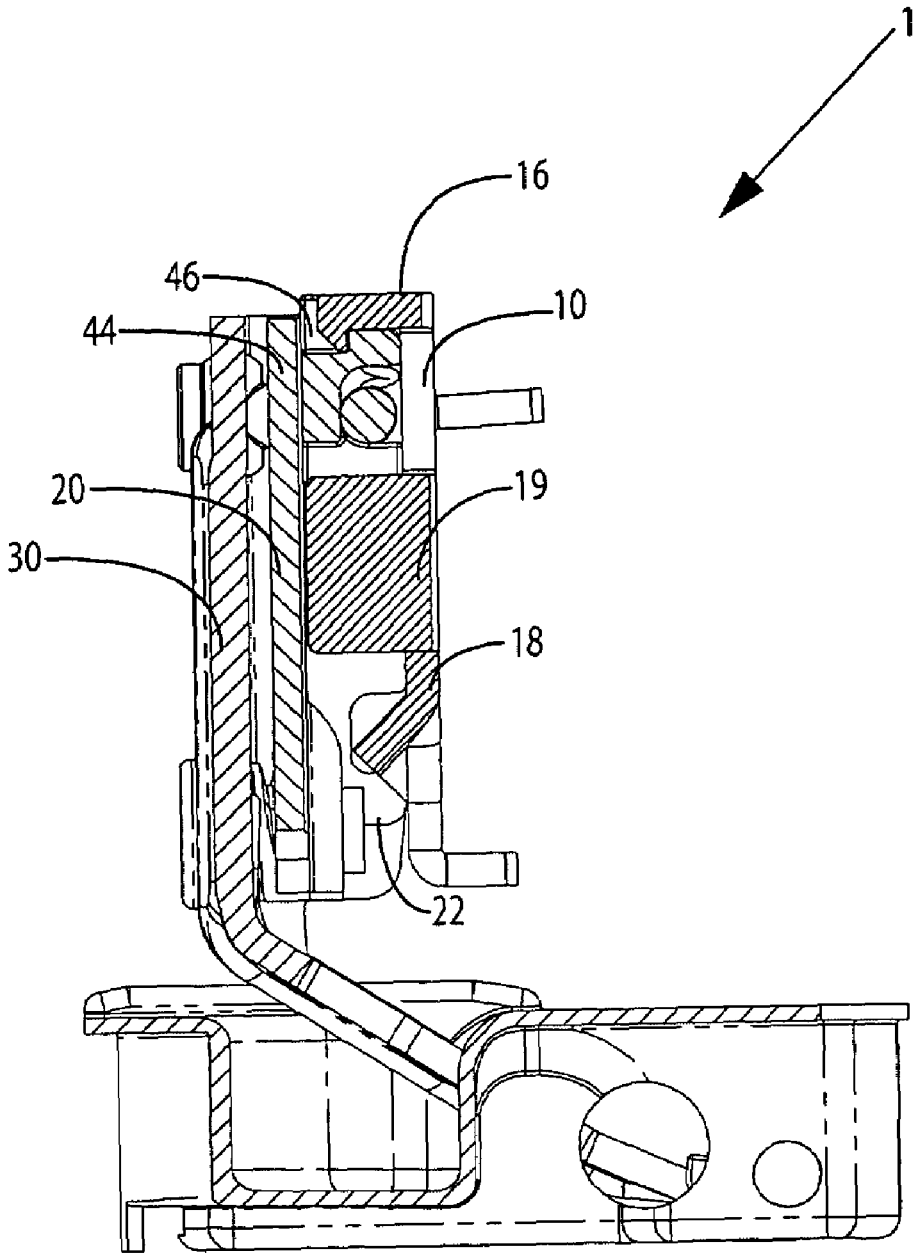
FIG. 2 illustrates a cross sectional view from the left side along line I—I as shown in FIG. 1.
Figure 3:
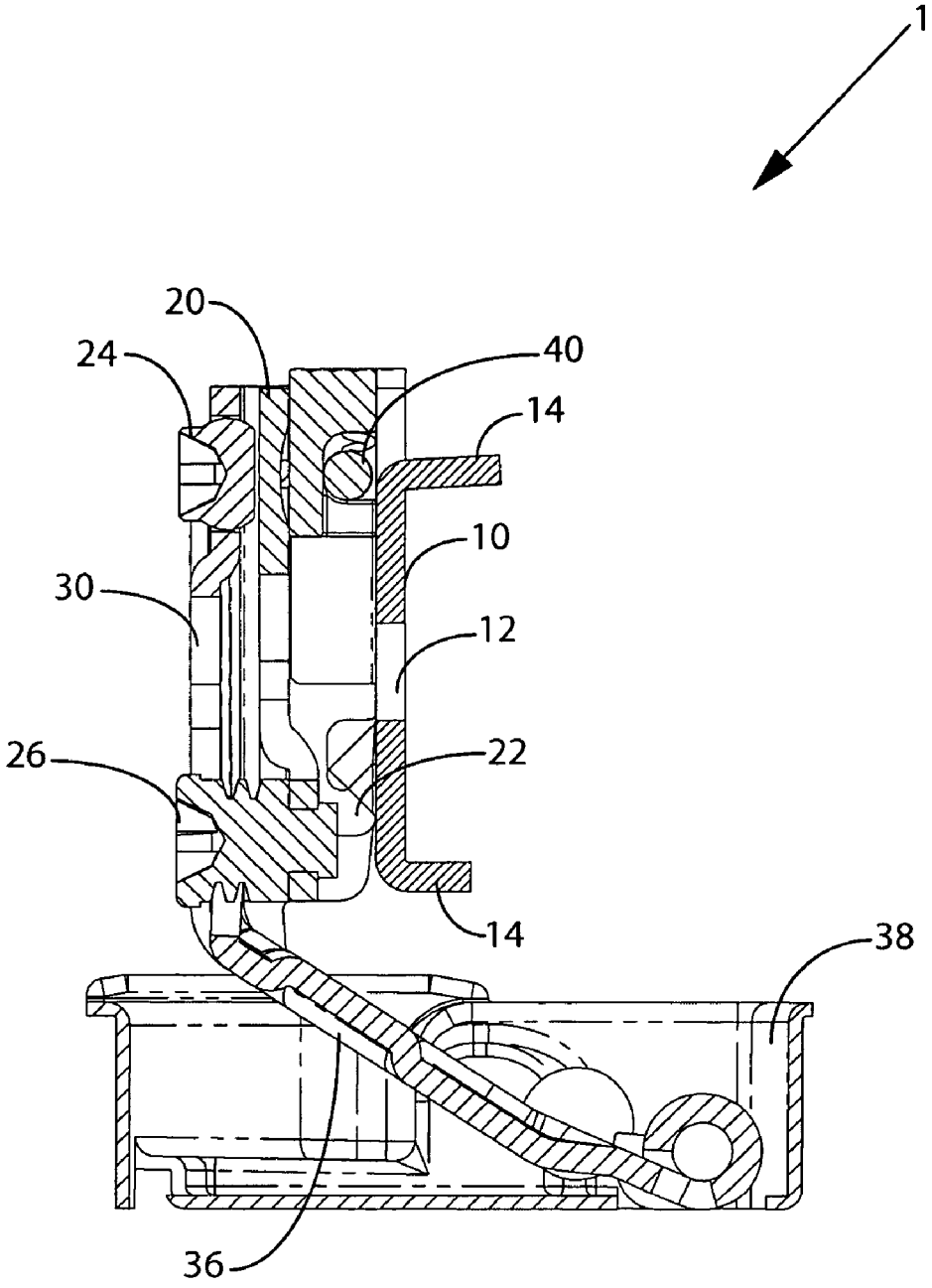
FIG. 3 illustrates a cross sectional view from the left side along line II—II as shown in FIG. 1.
Figure 4:
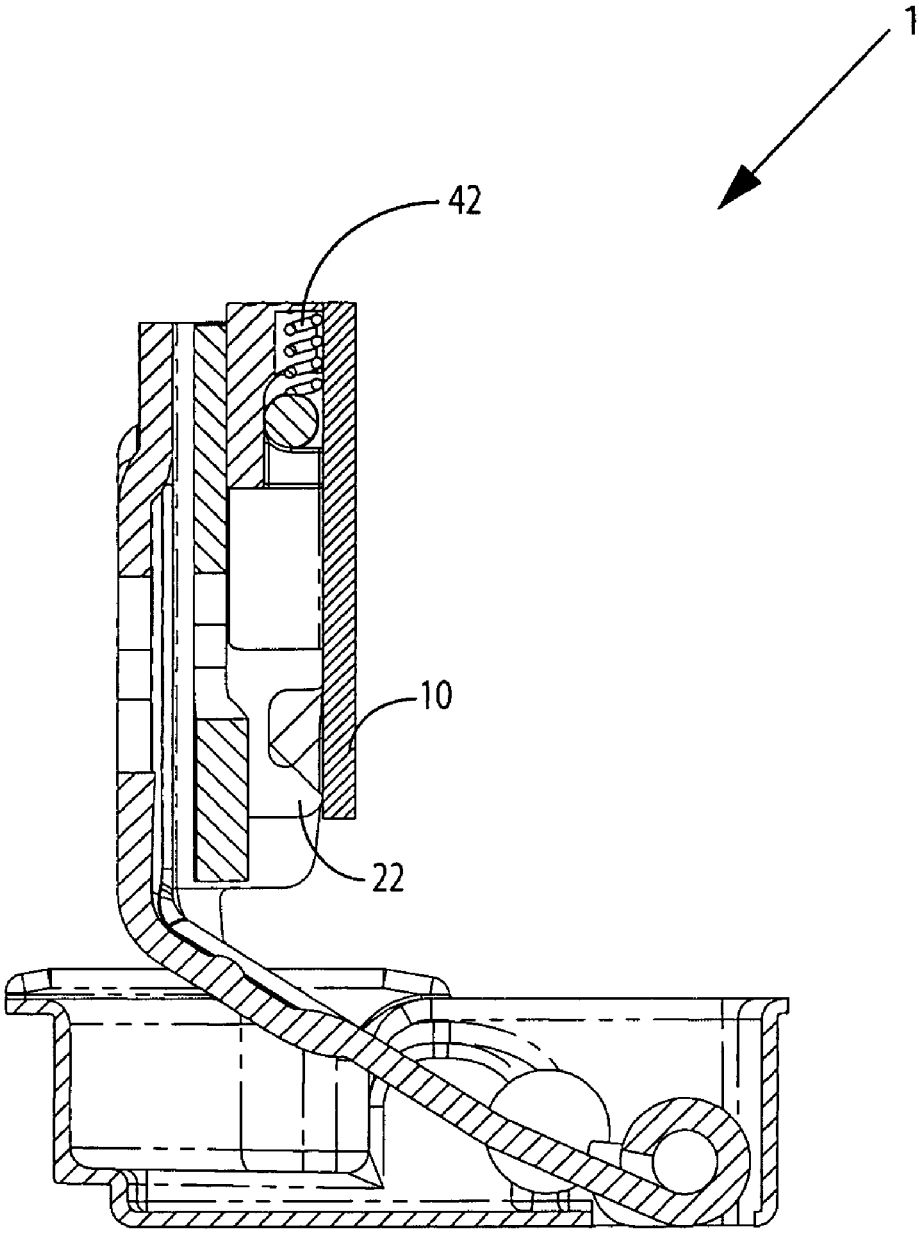
FIG. 4 illustrates a cross sectional view from the left side along line III—III as shown in FIG. 1.
Figure 5:
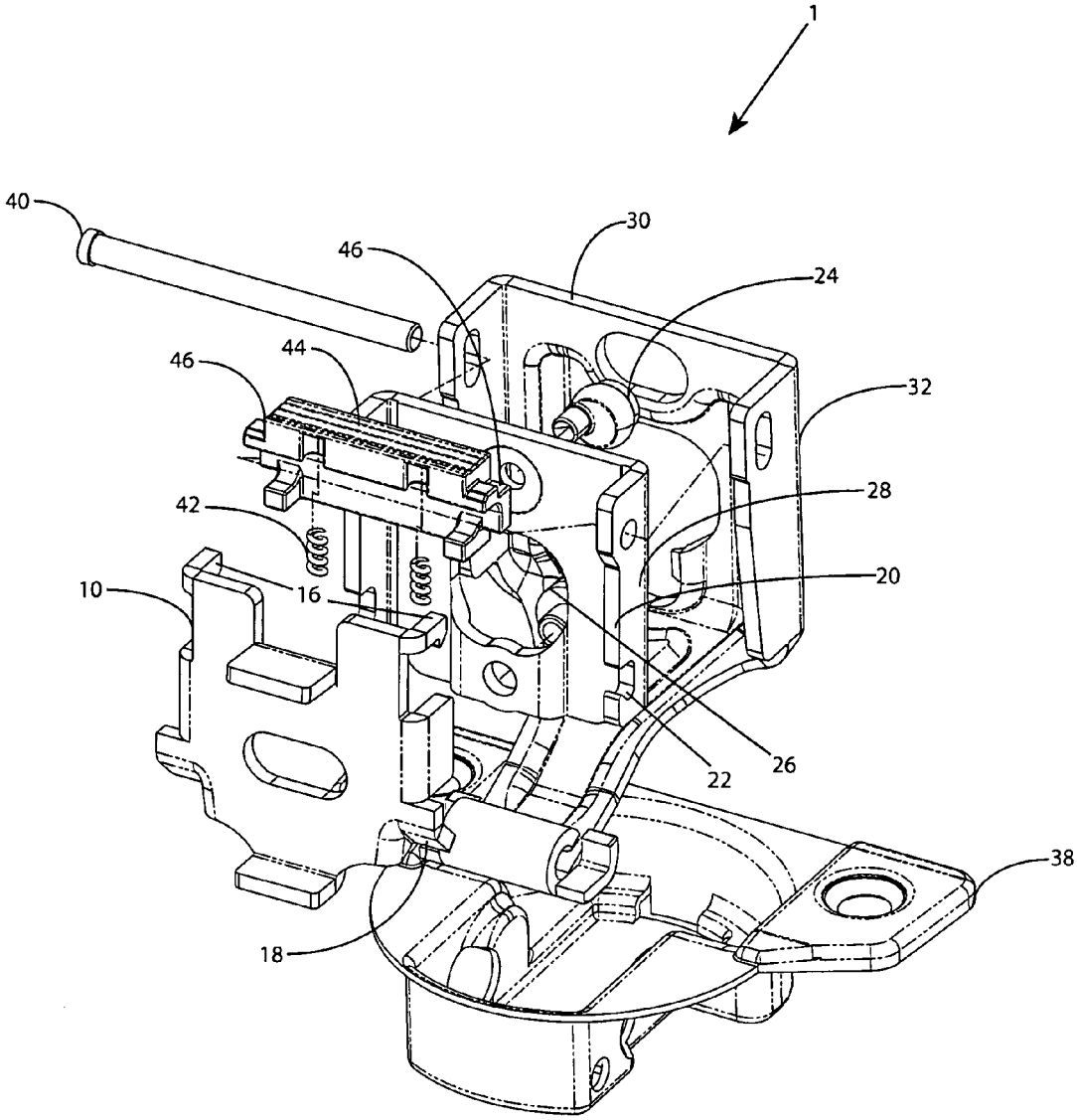
FIG. 5 illustrates an exploded view of an embodiment of the hinge of the present invention.
Figure 6:
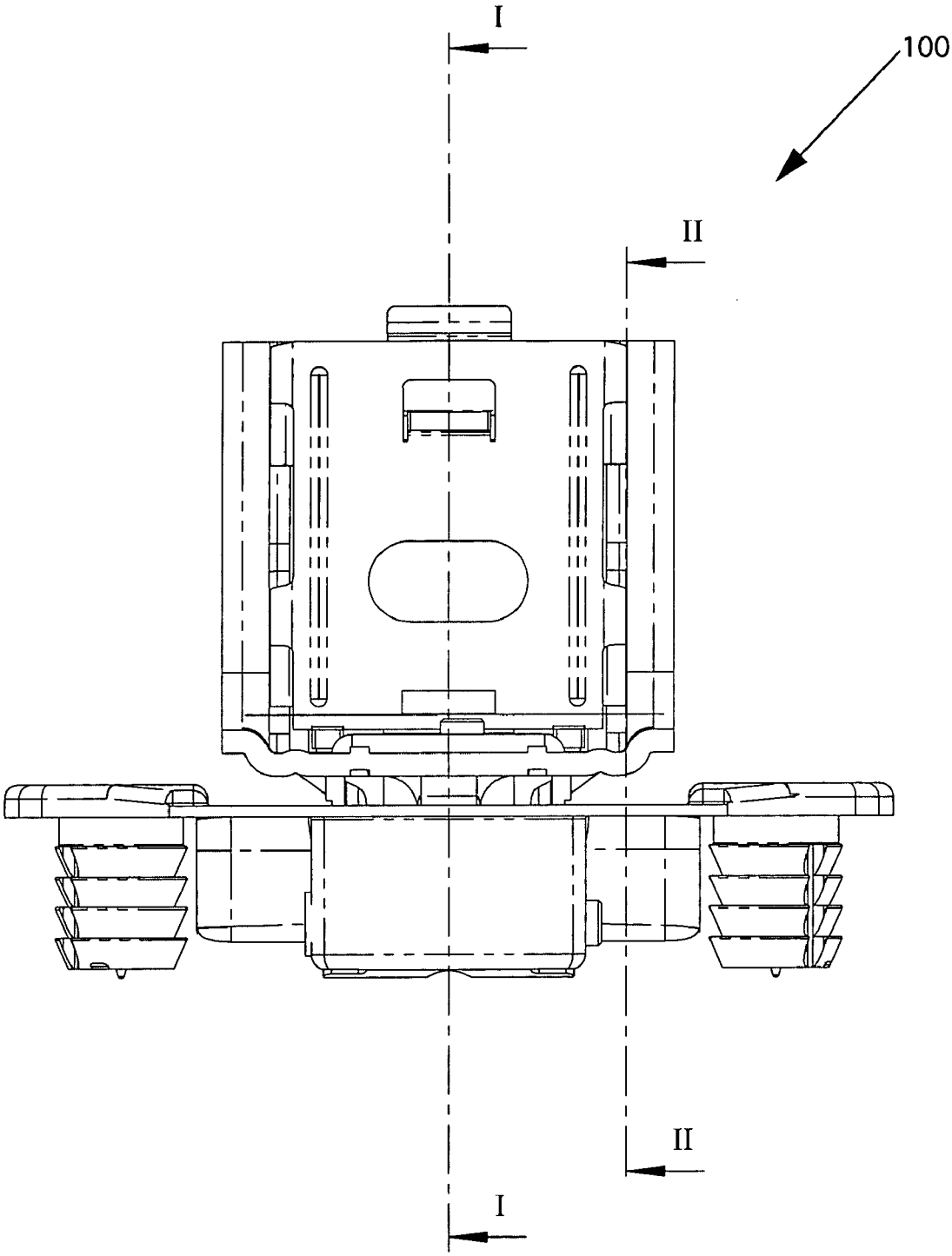
FIG. 6 illustrates a rear view from the left side of an embodiment of a hinge of the present invention.
Figure 7:
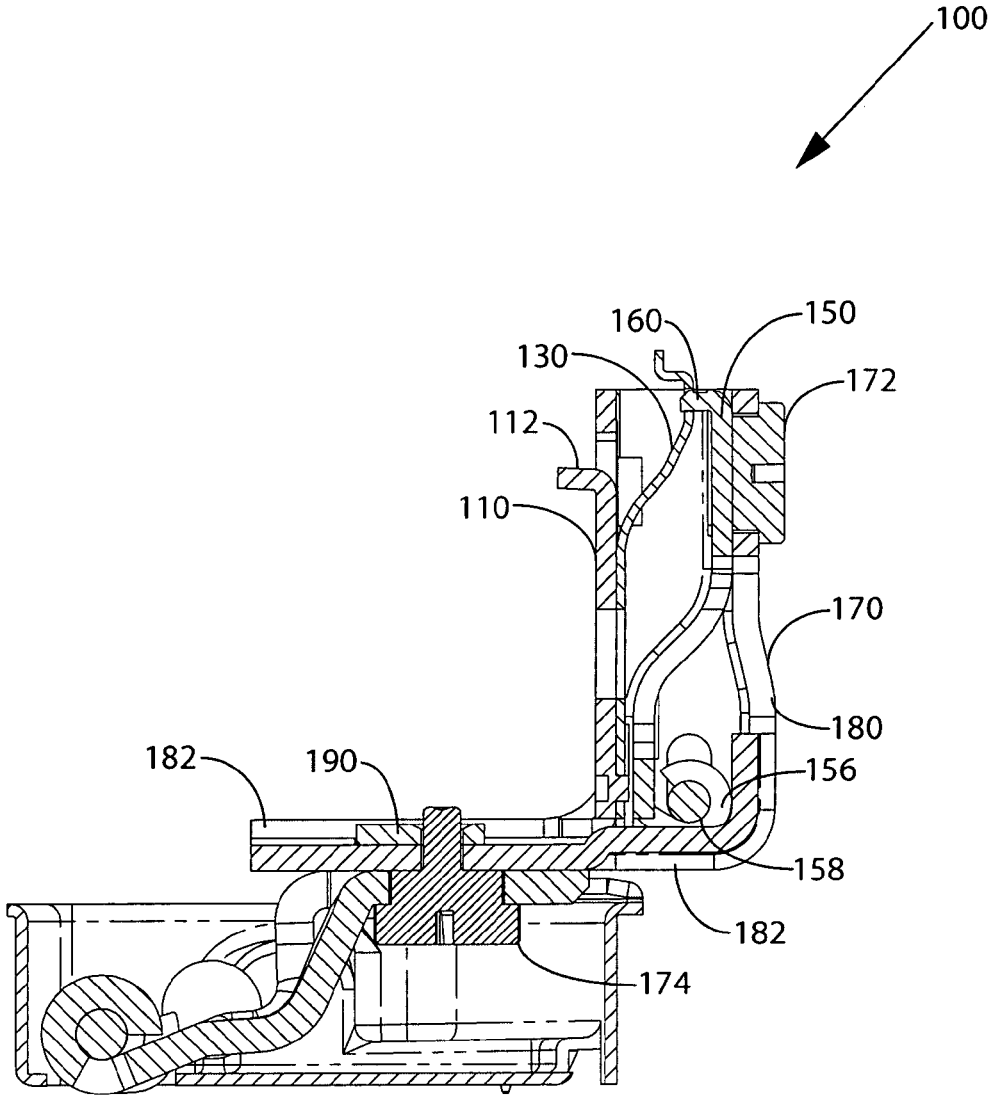
FIG. 7 illustrates a cross sectional view from the right side along line I—I as shown in FIG. 6.
Figure 8:
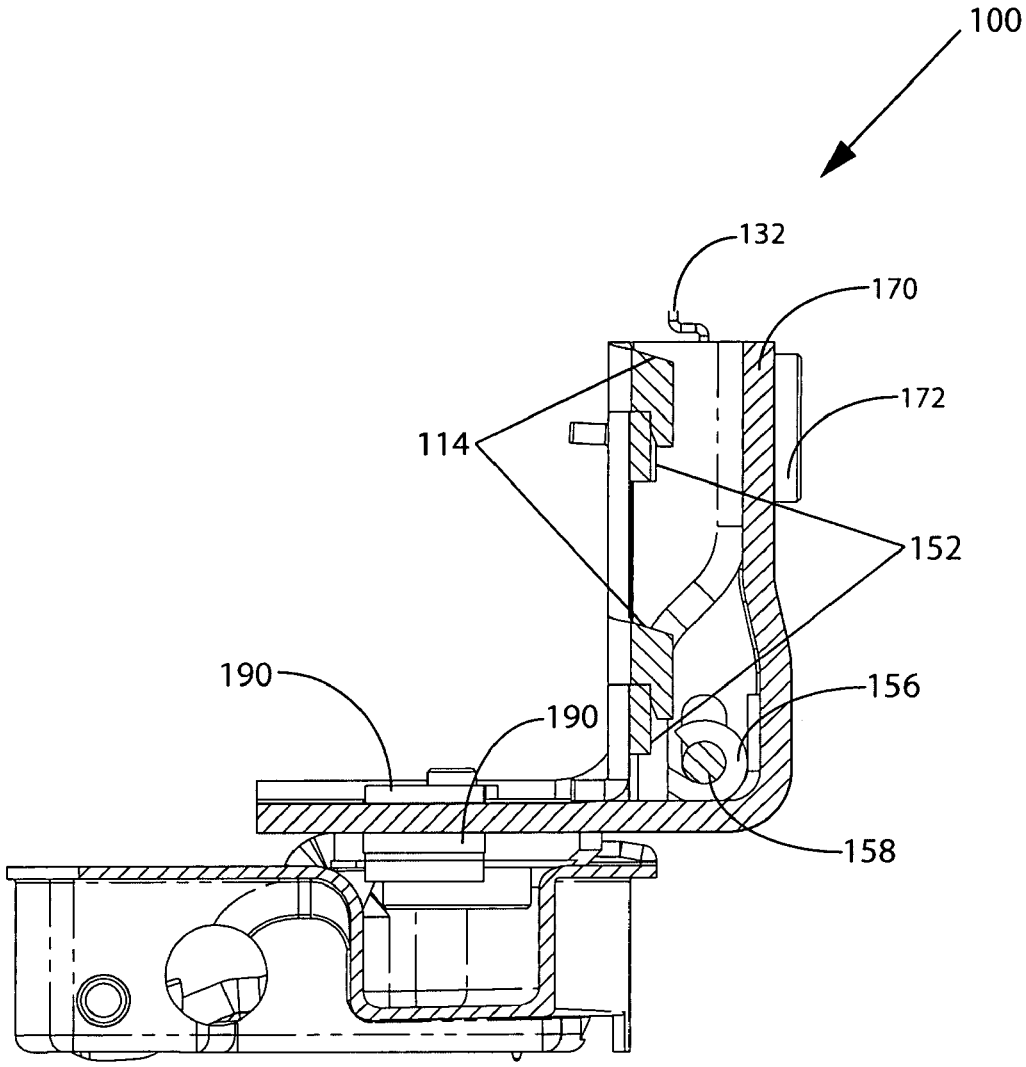
FIG. 8 illustrates a cross sectional view from the right side along line II—II as shown in FIG. 6.
Figure 9:
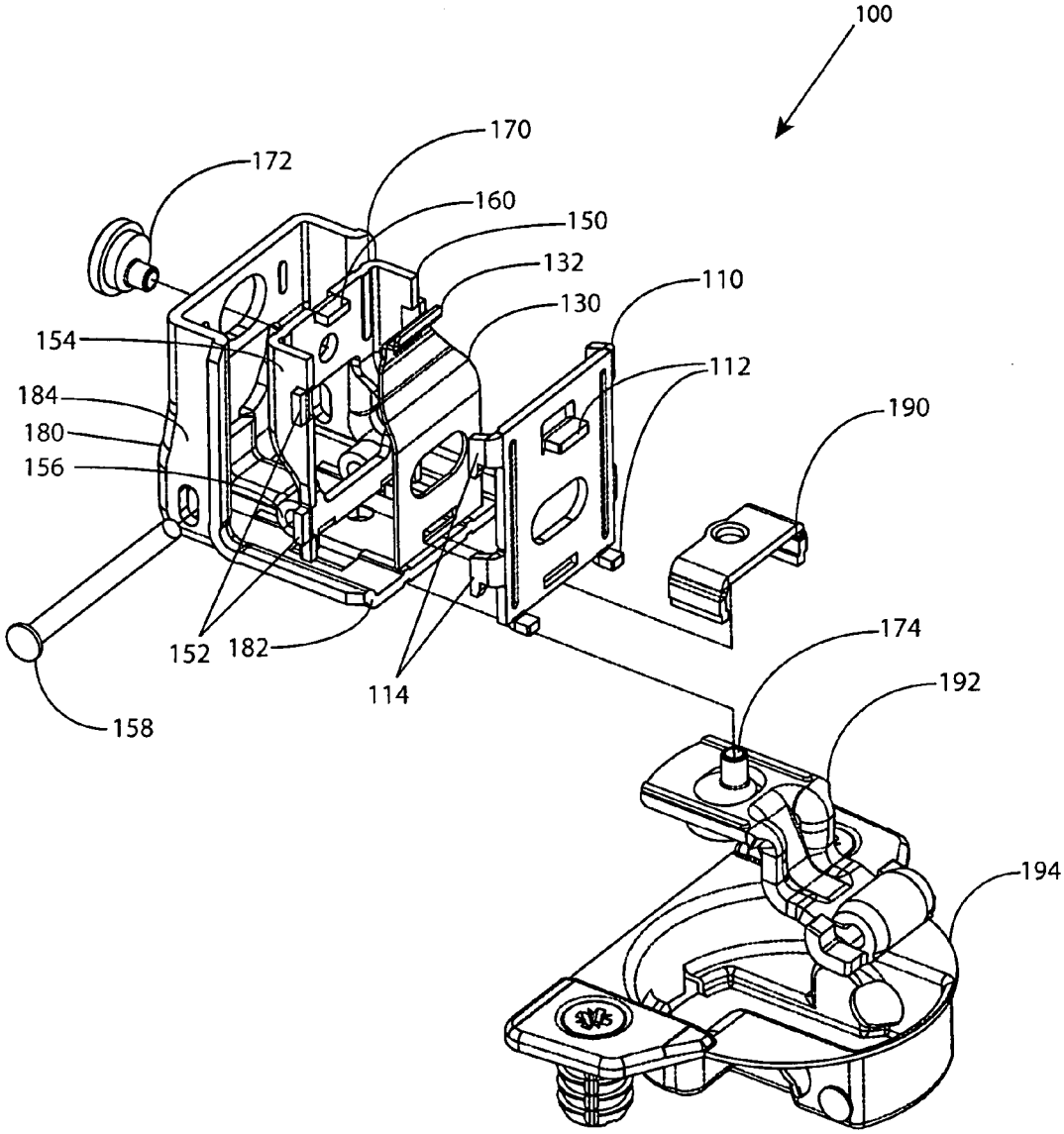
FIG. 9 illustrates an exploded view of an embodiment of the hinge of the present invention.

In a first aspect of the present invention, a low profile snap-on hinge with a partial overlay mounting configuration, is provided. This configuration is illustrated in FIGS. 1–5. The low profile hinge assembly is substantially similar to that disclosed in jointly assigned U.S. Pat. No. 6,647,591, issued Nov. 18, 2003 entitled "Low Profile, Partial Door Overlay Hinge", hereby incorporated by reference in full. This type of hinge assembly is employed to hang a door on the frame of a furniture article, such as a cabinet. FIG. 1 illustrates a bottom view of the hinge assembly 1 in a closed position (as the hinge would appear when the cabinet door is closed). FIGS. 2, 3 and 4 illustrate the cross section views taken along lines I, II, and III of FIG. 1, respectively. FIG. 5 illustrates an exploded view of the low profile hinge assembly.

The hinge assembly 1 comprises three plates, a frame plate 10, intermediate plate 20 and base plate 30. A spring assembly 42, 44, 46 is provided to releasably engage the intermediate plate 20 and the frame plate 10.

In an embodiment of the present invention, the frame plate 10 comprises a substantially flat body member with two sides and two ends, and two front hook portions 16, and a front catch member 18. The body member comprises an aperture 12 for receiving a mounting screw. In one embodiment of the present invention, the aperture 12 is elongated to allow height adjustment of the furniture door with respect to the furniture frame member. The frame plate 10 is attached to the furniture frame and secured in place by receiving a mounting screw extending through the aperture and into the furniture frame. The frame plate 10 further comprises leg portions 14 which extend from the bottom of the frame plate 10 and reside on either side of the furniture frame member. These portions assist in positioning the frame plate during installation and provide additional support to the furniture frame member to prevent cracking or splitting of the furniture material.

The rear hook portions 16 depend from the rear of the frame plate and are designed so as to form a catch for receiving a portion of a spring assembly. In a preferred embodiment of the present invention, the rear hook portions 16 extend from the frame plate toward the intermediate plate and comprise a forward extending protrusion or notch that forms the hook.

In a preferred embodiment of the present invention, the front catch member 18 comprises an angled extension of the base plate which angles toward the intermediate plate at an angle of less than 90 degrees. This provides an inclined catch surface for engaging and securing the intermediate plate against movement toward the rear of the base plate 10 and further provide a guide for positioning the intermediate plate 20 with respect to the base plate 10 prior to engaging the rear portions of the two plates.

In a further embodiment of the present invention, the front catch member 18 comprises a hook portion similar in design to the rear hook portions 16. In this embodiment, the catch member 18 extends outward from the frame plate 10 towards the intermediate plate 20, then extends horizontally toward the front of the frame plate to form a hook at the front of the frame plate.

In a further embodiment of the present invention, the frame plate 10 further comprises two side members extending from either side thereof, and extending toward the intermediate plate. These members provide lateral support by engaging the sides of the intermediate plate to prevent lateral motion of the intermediate plate relative to the frame plate.

The intermediate plate 20 comprises a body portion comprising means for engaging the front catch members of the frame plate. In a preferred embodiment of the present invention, the means for engaging the front catch members comprises two apertures 22 located on side members 28 which extend from opposite sides of the intermediate plate toward the frame plate. The apertures 22 are dimensioned and configured so as to be partially open toward the frame plate so as to engage and accept the front catch members of the mounting pate. Further, the side members comprise apertures for receiving a pin 40, which assists in securing the intermediate plate 20 to the base plate 30.

In an alternate embodiment of the present invention, the means for engaging the front catch members comprises an extension of the intermediate plate which extends downward toward the frame plate from the intermediate plate at an angle of less than 90 degrees to form an angled surface for engaging the front catch member of the frame plate.

In a preferred embodiment of the present invention, the spring assembly comprises a push button 44, two step members 46 positioned on either side of the push button 44, and two spring elements 42. This assembly is attached to the intermediate plate by a pin 44, which extends through a channel or aperture in the push button and through the apertures in either side member 28 of the intermediate plate 20. The channel in the push button 44 is dimensioned and configured so as to allow the push button a range of motion from a rearward extending position to inward position relative to the pin 40 and intermediate plate 20. Two springs 42 are positioned between the pin 40 and a bottom surface of the push button 44. The springs 42 act to maintain the push button in an extended position, but allow the push button to be depressed inward by compressing the springs against the stationary pin 44. In one embodiment of the invention, the springs are housed within guide channels within the body of the push button. The depth of the channels, size and tension of the spring, and range of motion of the push button may all be varied depending on the particular design requirements of the hinge.

In a further embodiment of the present invention, the step members 46 receive and engage the rear hook portions of the frame plate 10. When the hinge is assembled, the front hook portions 16 of the frame plate 10 engage the steps 46 of the push button to releasably engage the intermediate plate 20 to the frame plate 10. The springs 42 provide resistance to keep the push button in the fully extended position, and the steps 46 engaged with the front hooks 16. In this manner, the rear portion of the intermediate plate 20 is releasably engaged to the rear portion of the frame plate 10. Any movement of the intermediate plate rearward, or upward relative to the frame plate 10 will be arrested through the contact between the rear hooks 16 and step members 46. When it is desired to separate the intermediate plate 20 from the frame plate 10, the push button is pressed inward, toward the front of the hinge assembly, against the tension of the springs 42, until the step members 46 are clear of the rear hooks 16, and the intermediate plate 20 is detachable from the frame plate 10.

In one embodiment of the present invention, the base plate 30 comprises a substantially flat body portion and two side members 32 extending from opposite sides of the body portion. The side members 32 extend toward the intermediate plate 20 and frame plate 10, and further comprise apertures for receiving the pin 40. The base plate 30 further comprises means for pivotably connecting the base plate to a hinge cup 38. The hinge cup 38 is further adapted to be mounted to the door of the furniture member.

In a preferred embodiment of the present invention, the means for pivotally mounting a hinge cup 38 comprises an extension of the base plate 30 that forms a hinge arm 36. In another embodiment of the present invention, the hinge arm 36 is formed separately from the base plate 30 and secured thereto via screws, clips or other fasteners.

In another embodiment of the present invention, the base plate 30 and intermediate plate 20 are engaged and adjustable with respect to each other through two adjustment screws. A first adjustment screw comprises a depth adjustment cam screw 24 extending through an oblong aperture in the base plate 30. The cam screw 24 comprises an off-center extension which engages a circular aperture in the intermediate plate 20. The top of the cam screw 24 preferably comprises a slot for receiving screw driver such that the cam screw 24 may be rotated to adjust the position of the base plate 30 relative to the intermediate plate 20. When the cam screw is rotated, the off-center extension engaging the intermediate plate 20 rotates around the central axis of the cam screw producing a front to rear motion of the base plate 30 relative to the intermediate plate 20. Oblong apertures in the side members 32 of the base plate 30 guide the pin 40, and subsequently the intermediate plate 20 in this motion. This translates into an adjustment of the furniture door toward or away from the furniture frame member. In this manner, the depth of the furniture door may be adjusted.

A second adjustment screw is provided to further adjust the base plate 30 relative to the intermediate plate 20. This second screw comprises a threaded screw 26 which is positioned through an aperture on the base plate 30 which comprises guide means for receiving the threads of the threaded screw. The threaded screw 26 further extends into a circular aperture in the intermediate plate 20. As the threaded screw is turned, the guide means of the base plate 30 ride up or down the threads thereby lifting or lowering the position of the base plate 30 relative to the intermediate plate 20. This translates into a lateral, left-to-right, adjustment of the furniture door. In this manner the horizontal position of the door may be adjusted.

In a preferred embodiment of the present invention, the cam screw 24 is rounded at the top such that it acts as a ball joint in connection with the oblong aperture in the base plate. This allows the base plate 30 to move relative to the cam screw 24 when the threaded screw 26 is turned. The angle of contact between the base plate 30 and the cam screw 24 will vary as the base plate moves up and down; however, the base plate and cam screw will remain securely in contact with one another through this motion with the base plate "riding" along the circumference of the cam screw.

In a preferred embodiment of the present invention, the hinge is installed by securing the frame plate 10 to a furniture frame member with a fastener, such as a screw, extending through an aperture in the frame plate 10. The intermediate plate 20 and base plate 30 are securely attached to each other through the pin 40, the cam screw 24, and the threaded screw 26. Through the cam screw 24, the position of the base plate 30 is adjustable front to rear relative to the intermediate plate 20. The oblong apertures in the side members 32 of the base plate 30, as well as the guide means of the threaded screw aperture in the base plate 30, allow the base plate to slide front to back while maintaining contact with the pin 40 and threaded screw 26. Similarly, the threaded screw 26 when turned, effects a lifting or lowering motion of the front of the base plate 30, while the rear of the base plate is hinged by the pin 40. The rounded nature of the head of the cam screw 24 further allows this hinging motion while securely retaining the base plate and intermediate together as one assembly.

The intermediate plate 20 and base plate 30 are attachable and detachable to the frame plate 10, which is securely attached to the furniture frame. To engage the intermediate plate 20 with the frame plate 10, the intermediate plate 20 is positioned over the frame plate and the front projection 22 of the intermediate plate 20 is engaged to the front catch member 18 of the frame plate 10. The rear of the intermediate plate is then brought toward the frame plate 10 until the hook portions 16 of the frame plate 10 engage the steps 46 of the intermediate plate 20. During this operation, the hook portions 16 will slide along and apply pressure to the outer surface of the push button 44 in the region just below the steps 46. This pressure will cause the springs 42 to compress and allow the push button 44 to move inward, toward the front of the hinge, and allow the hook portions 16 to pass. When the intermediate plate 20 is fully engaged with the frame plate 10, the hook portions 16 will reside within the steps 46 which allows the springs 42 to expand and move the push button 44 rearward thereby locking the hinge assembly together.

To disengage the intermediate plate 20 from the frame plate 10, the push button 44 is depressed, moving toward the pin 40, and the springs 42 are compressed against the pin 40. This allows the steps 46 of the push button 44 to disengage from the hook portions 16 of the frame plate 10. Once the steps 46 have cleared the hook portions 16, the intermediate plate 20 and base plate 30 may be lifted off and detached from the frame plate 16.

In another aspect of the present invention, a snap-on hinge with a full overlay mounting assembly is provided. One embodiment of the full overlay hinge aspect of the present invention is illustrated in FIGS. 6–9. The full overlay hinge assembly is substantially similar to that disclosed in jointly assigned U.S. Pat. No. 6,643,895, issued Nov. 11, 2003 entitled "Full Overlay Hinge", and U.S. Pat. No. 6,694,567, issued Feb. 24, 2004 entitled "Full Overlay Hinge", which is a CIP of the '895 patent, both of which are herein incorporated by reference in full.

The full overlay hinge assembly 100 comprises a frame plate 110 affixed to a furniture frame, an intermediate plate 150, a spring assembly 130 for releasably engaging the intermediate plate to the frame plate, and a base plate 170.

In one embodiment of the present invention, the frame plate 110 comprises a substantially flat rectangular plate comprising an aperture for receiving a fastening device, such as a screw. The frame plate 110 further comprises a means for engaging with an intermediate plate. In a preferred embodiment of the present invention, the means for engaging the frame plate 110 to an intermediate plate 150 comprises two sets of hook members 114 that are positioned on opposite sides of the frame plate 110 with the first set positioned proximate to one end of the frame plate, and the other set positioned proximate to the opposite end of the frame plate. The hook members extend outward from the frame plate at substantially a 90 degree angle for a distance before extending 90 degrees therefrom to form a hook.

In another embodiment of the present invention, the hook members 114 comprise one set of two hooks on either side of the frame plate, wherein each hook member extends from one end of the frame plate, and extends down the side of the frame plate to form a long slot. In this embodiment, the long slot is formed, between the hook member and the frame plate, for receiving a portion of the intermediate plate 150.

In an embodiment of the present invention, the spring assembly comprises a retention spring 130 fixedly attached to the frame plate 110, and further comprises a means for releasably engaging the intermediate plate 150. In a preferred embodiment of the present invention, the retention spring 130 comprises a leaf spring. The leaf spring provides the requisite tension while remaining substantially flat, so as not to substantially increase the overall size of the hinge. The spring 130 is affixed to the frame plate 110 near the front end of the hinge assembly. The spring 130 extends through the assembly between the hook members 114 of the frame plate 110. Near the back end of the frame plate 10, the spring bends away from the frame plate 110 and extends slightly further than the back end of the frame plate 110. The bend provides the tension in the leaf spring 130, and the extension of the spring 130 farther than the back of the frame plate 110 comprises a finger tab 132 which allows access to manipulate the position of the spring 130.

In the area adjacent to the finger tab, the spring comprises a means for releasably engaging the intermediate plate. In a preferred embodiment of the present invention, the means for releasably engaging the intermediate plate 150 comprises a slot in the spring 130 for accepting a tab 160 extending from the intermediate plate 150. When the tab 160 extends through the slot, the spring is held in a tensed state. This applies force between the frame plate 110 and the intermediate plate 150 which keeps the two components engaged. Upon release of the spring 130 by pushing the spring toward the frame plate 110, the tab 160 exits the slot on the spring 130, the tension in the spring is released and the intermediate plate 150 is free to disengage from the hook members 114 of the frame plate 110.

In a further embodiment of the present invention, the intermediate plate 150 comprises a body portion having two side members 154 that extend from opposite edges of the body portion toward the frame plate 110. The side members 154 each comprise a plurality of hook engagement members 152 for engaging the plurality of hook members 114 of the frame plate 110. At a back end of the intermediate plate 150 a tab 160 for releasably engaging the retention spring 130 is provided, extending inward toward the frame plate 110 and spring 130. At a front end of the intermediate plate 150 hooks 156 are provided for rotatably engaging a pin 158.

In a preferred embodiment of the present invention, the hook engagement members 152 comprise two sets of tabs extending from the side members 154. The tabs are dimensioned and configured to slide into and engage the hook members 114 to prevent the intermediate plate 150 from moving away from the frame plate 110 or towards the rear of the assembly. The tension provided by the spring element 130 prevents the intermediate plate from moving towards the front of the assembly and disengaging from the hooks, thereby securing the intermediate plate and frame plate together.

In another embodiment of the present invention, the hooks 156 for rotatably engaging a pin 158 comprise a portion of the material from the intermediate plate 150 which has been curled into a circular hook shape. This circular hook shaped material wraps around the pin 158, such that the pin extends through the hook. In a preferred embodiment of the present invention, the hooks 158 extend from the intermediate plate 150 toward the base plate 170 such that they are positioned in the area between the intermediate plate 150 and the base plate 170.

In another embodiment of the present invention, the hooks 156 on the intermediate plate 150 comprise apertures in additional side members which extend from the intermediate plate 150 toward the base plate 170. These side members are in addition to the frame plate facing side members discussed above, such that the intermediate plate 150 has two sets of side members, extending in opposite directions from each side of the intermediate plate 150. The additional side members each comprise an aperture for receiving the pin 158, and securing the intermediate plate 150 to the base plate 170.

In a further embodiment of the present invention, the base plate 170 comprises a body portion 180, a leg portion 182, and two side member 184 extending from the body portion 180 toward the frame plate 110. The side members 184 each comprise a pin aperture for receiving a pin 158. The pin extends from one pin aperture across the width of the base plate 170 and into the opposite pin aperture. The hooks 156 on the intermediate plate 150 wrap around the pin so as to secure the intermediate plate 150 to the base plate 170 via the pin 158. This allows for movement of the intermediate plate 150 relative to the base plate 170 through rotation on the pin 158.

In another embodiment of the present invention, the hinge assembly 100 further comprises means for pivotably attaching a hinge cup 194 to the base plate 170. In one embodiment of the present invention, the means for pivotably attaching a hinge cup 194 comprises a clip 190, a hinge arm portion 192, and a hinge cup 194. The hinge arm portion 192 is slideably connected to the L-shaped hinge arm portion 170 by insertion of the clip 190 into accommodating apertures in the leg portion 182 of the base plate 170. The legs of the clip 190 protrude through the front of the leg portion 182 of the base plate to provide a slideable connection for the hinge arm portion 192. Hinge arm portion 192 comprises a relatively flat surface for sliding between the legs of the clip 190 and being retained therein. On the opposite side of the hinge arm portion 190 is a means for pivotably connecting a hinge cup 194. The hinge cup 194 is mounted to the furniture door.

In an additional embodiment of the present invention, the base plate 170 further comprises two adjustment screws 172 and 174 for adjusting the position of the door relative to the furniture frame. A first cam screw 172 extends through an oblong aperture in the body 180 of the base plate 170. An off-center protrusion on the cam screw 172 extends into a circular aperture on the intermediate plate 150. When the first cam screw 172 is rotated, the base plate 170 moves from front to back relative to the intermediate plate 150, which in turn, moves the furniture door toward or away from the furniture frame. In this embodiment, the pin apertures on the side members 184 of the base plate 170 are elongated to accommodate movement of the pin 158 along with the intermediate plate 150, relative to the base plate 170. In this manner, the spacing of the furniture door may be adjusted relative to the face of the furniture frame.

The second adjustment screw 174 extends through an oblong aperture in the hinge arm portion 192. An off-center protrusion on the cam screw 174 extends through a circular aperture in the leg portion 182 of the base plate 170. When the second cam screw 174 is turned, the hinge arm portion 192 moves relative to the base plate 170 resulting in a left to right movement of the furniture door. In this manner, the left to right orientation of the furniture door, and resultant spacing between two adjacent furniture doors, may be adjusted.

In one embodiment of the present invention, the intermediate plate 150 is releasably engaged to the frame plate 110 by positioning the intermediate plate 150 over the base and sliding the hook engagement members 152 of the intermediate plate 150 under the hook members 114 of the frame plate 110. The finger tab 132 on the retention spring 130 is then employed to position the aperture in the spring over the spring engagement tab 160 such that the tab 160 protrudes through the spring. This action creates tension in the spring which retains the intermediate plate 150 in position, by preventing the intermediate plate from moving and disengaging the hook engagement members 152 from the hook members 114.

When it is desired that the intermediate plate 150 be released from the frame plate 110, the finger tab 132 on the retention spring 130 is manipulated to slide the spring 150 off and away from the spring engagement tab 160. When the spring 130 is free from the engagement tab 160, the tension in the spring will release and the intermediate plate 150 will no longer be restrained from moving relative to the frame plate 110, and disengaging the hook engagement members 152 from the hook members 114. In this manner, the intermediate plate may be removed from the frame plate.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention.

What is claimed is:

1. A hinge assembly comprising:

a frame plate for engagement to a furniture frame member comprising means for engaging a spring assembly;

an intermediate plate comprising means for rotatably engaging the intermediate plate with a pin, and two side members;

a spring assembly for releasably engaging the intermediate plate to the frame plate; and, a base plate comprising two side members each having at least one aperture therein, and a pin;

wherein the pin extends through the apertures on the side members of the base plate and the means for rotatably engaging the intermediate plate with a pin provide a slideable engagement between the base plate and the intermediate plate; and wherein the spring assembly provides a releasable engagement between the frame plate and the intermediate plate.

2. The hinge assembly of claim 1, wherein the means for rotatably engaging the intermediate plate with a pin comprises at least one aperture on each of the side members of the intermediate plate through which the pin extends.

3. The hinge assembly of claim 1, wherein the means for rotatably engaging the intermediate plate with a pin comprises two hooks extending from the intermediate plate and wrapping at least partially around the pin.

4. The hinge assembly of claim 1 wherein the spring assembly comprises a push button spring assembly.

5. The hinge assembly of claim 4 wherein the frame plate further comprises two front catch members, and two rear hook portions, the intermediate plate further comprises two front apertures on the side members, and wherein the push button spring assembly comprises a push button having two step members tensioned against the hook portions by two springs compressed between the pin and the push button, such that the intermediate plate is separably engageable to the frame plate through the interaction between the front catch members of the frame plate and the front apertures of the intermediate plate side members and the rear hook portions and the step members.

6. The hinge assembly of claim 1 wherein the spring assembly comprises a leaf spring.

7. The hinge assembly of claim 6, wherein the frame plate further comprises a plurality of hook members and means for engaging the leaf spring, the intermediate plate further comprises a plurality of hook engagement members and a spring engagement tab, such that the intermediate plate is separably engageable to the frame plate by sliding the hook engagement members into the hook members of the frame plate and securing the leaf spring to the tab on the intermediate member.

8. The hinge assembly of claim 1 wherein the base plate further comprises two adjustment screws for adjusting the position of a furniture door engaged to the hinge assembly.

9. A hinge assembly comprising:

a frame plate comprising means for securing said frame plate to a furniture frame member, two rear hook members and two front catch members;

a an intermediate plate comprising a body portion comprising means for engaging the front catch member of the frame plate, and a push button assembly comprising, at least one spring, and at least one step on the push button for engaging the rear hook member of the frame plate, said at least one spring being positioned to supply tension to the push button such that the step engages the at least one rear hook member of the frame plate;

the intermediate plate further comprising two side members which extend from opposite sides of the intermediate plate and comprise rear apertures for receiving the pin and front apertures for engaging each of the front catch members of the frame plate; and, a base plate comprising means for securing the base plate to the intermediate plate.

10. The hinge assembly of claim 9, further comprising a depth adjustment screw for adjusting the depth of the door relative to the furniture frame member.

11. The hinge assembly of claim 9, further comprising a horizontal adjustment screw for adjusting the position of the door horizontally relative to the furniture frame member.

12. The hinge assembly of claim 9, wherein the push button assembly comprises two springs and two steps on the push button for engaging the rear hook members of the frame plate.

13. The hinge assembly of claim 12, wherein the intermediate plate and the base plate are releaseable from the frame plate by pressing the push button against the force of the springs until the steps on the push button disengage from the hook members on the frame plate thereby allowing the intermediate plate to be separated from the frame plate.

14. The hinge assembly of claim 9, wherein the push button comprises means for receiving the pin and securing the springs against said pin under tension, such that the springs provide force to extend the push button toward the rear of the hinge.

15. The hinge assembly of claim 9 wherein the base plate substantially covers the intermediate plate and the frame plate when the hinge assembly is assembled and installed in a furniture article.

16. A hinge assembly comprising:

a frame plate comprising means for securing the frame plate to the furniture frame, a plurality of hook members extending from opposite sides of the frame plate, and a retention spring securely attached to a front end of the frame plate and extending towards a back end of the frame plate between the plurality of hook members;

an intermediate plate comprising a plurality of protrusions which engage the plurality of hook members on the frame plate, and means for releasably engaging the intermediate plate to the retention spring, and a round aperture formed through the intermediate plate; and, a base plate comprising a body portion and a leg portion extending substantially perpendicular from the front end of said body portion, and an oval aperture formed through the base place, wherein a cam screw extends through the oval aperture of the base plate, and into the round aperture of the intermediate plate, such that rotating the cam screw causes the base plate to move relative to the intermediate plate.

17. The hinge assembly of claim 16 wherein the plurality of hook members on the frame plate further comprises four hook members.

18. The hinge assembly of claim 16, wherein the retention spring comprises a leaf spring.

19. The hinge assembly of claim 16, wherein the means for releasably engaging the retention spring comprises an inward facing tab extending from a back end of the intermediate plate and through an aperture in the retention spring.

20. The hinge assembly of claim 16, wherein the intermediate plate and base plate are released from the frame plate by pressing a finger tab on the retention spring to move the rearward portion of the retention spring away from the tab, thereby releasing the tension in the spring and allowing the base plate and intermediate plate to be removed from the frame plate.

21. The hinge assembly of claim 16 wherein the base plate substantially covers the intermediate plate and frame plate when the hinge assembly is assembled and installed in a furniture article.

* * * * *

UNITED STATES PATENT AND TRADEMARK OFFICE

CERTIFICATE OF CORRECTION

PATENT NO. : 6,996,877 B2
APPLICATION NO. : 10/815364
DATED : February 14, 2006
INVENTOR(S) : Todd Booker and Georg Domenig It is certified that error appears in the above-identified patent and that said Letters Patent is hereby corrected as shown below:

Column 9, line 27, that portion reading "110. Near the back end of the frame plate 10", should read -- 110. Near the back end of the fram plate 110 --.

Column 12, line 35, that portion reading "a an intermediate plate comprising a body portion" should read -- an intermediate plate comprising a body portion --.

Signed and Sealed this

Twenty-eighth Day of November, 2006

JON W. DUDAS
*Director of the United States Patent and Trademark Office*